US007367474B2

(12) United States Patent
Lin

(10) Patent No.: US 7,367,474 B2
(45) Date of Patent: May 6, 2008

(54) GAS-POWERED GLUE GUN

(76) Inventor: Arlo Lin, No. 68, Kung Yeh 32nd Road, Industrial Park, Taichung (TW)

( * ) Notice: Subject to any disclaimer, the term of this patent is extended or adjusted under 35 U.S.C. 154(b) by 0 days.

(21) Appl. No.: 11/624,822

(22) Filed: Jan. 19, 2007

(65) Prior Publication Data

US 2007/0114241 A1 May 24, 2007

Related U.S. Application Data

(63) Continuation-in-part of application No. 11/028,019, filed on Jan. 3, 2005, now abandoned.

(51) Int. Cl.
*B65D 5/66* (2006.01)
*B44D 3/16* (2006.01)

(52) U.S. Cl. ..... 222/113; 222/146.5; 222/146.2; 126/401

(58) Field of Classification Search ..... 222/146.5, 222/146.2, 113; 126/401–406, 407, 284; 431/344, 345; 219/616, 88.12
See application file for complete search history.

(56) References Cited

U.S. PATENT DOCUMENTS

| | | | |
|---|---|---|---|
| 4,535,916 | A | 8/1985 | Macherle et al. |
| 4,755,073 | A | 7/1988 | Girardin et al. |
| 4,795,064 | A | 1/1989 | Sheu |
| 4,949,881 | A | 8/1990 | Watanabe et al. |
| 5,048,722 | A | 9/1991 | Lichu |
| 5,479,914 | A | 1/1996 | Tsai |
| 5,799,648 | A | 9/1998 | Oglesby et al. |
| 5,895,159 | A | 4/1999 | Liou |
| 5,901,881 | A | 5/1999 | Wang |
| 5,960,996 | A | 10/1999 | Hsu |
| 6,065,888 | A | 5/2000 | Maayeh |
| 6,457,889 | B1 | 10/2002 | Lin |
| 6,652,175 | B2 | 11/2003 | Chang |
| 2006/0021997 | A1 | 2/2006 | Lin |

FOREIGN PATENT DOCUMENTS

| | | | | |
|---|---|---|---|---|
| GB | 0123259 | * | 4/1984 | ..... 222/113 |

* cited by examiner

*Primary Examiner*—Kevin Shaver
*Assistant Examiner*—Stephanie E. Tyler
(74) *Attorney, Agent, or Firm*—Alan Kamrath; Kamrath & Associates PA

(57) ABSTRACT

A glue gun includes a shell, a burner, a mixture chamber, a barrel and a dispenser. The burner is disposed in the shell and formed with a combustion chamber and a thermal chamber. The mixture chamber is connected to the combustion chamber. The barrel is inserted through the thermal chamber. The dispenser is connected to the barrel. Gas is mixed with air in the mixture chamber. The mixture is sent into the combustion chamber from the mixture chamber. Heat is generated as the mixture is ignited and combusted in the combustion chamber. The thermal chamber transfers the heat to the barrel from the combustion chamber. The barrel heats and melts a glue stick inserted therein. The dispenser dispenses the molten glue from the barrel.

17 Claims, 6 Drawing Sheets

GAS-POWERED GLUE GUN

CROSS-REFERENCE

The present application is a continuation-in-part of U.S. Patent application Ser. No. 11/028,019 filed on Jan. 3, 2005, now abandoned.

BACKGROUND OF INVENTION

1. Field of Invention

The present invention relates to an efficient gas-powered glue gun.

2. Background of Invention

According to U.S. Pat. No. 5,799,648, a conventional glue gun 80 includes a shell 81 including a main portion 82 and a handle portion 83. A main body 85 is installed in the main portion 82 of the shell 81. The main body 85 defines a combustion chamber 10 and an exhaust port 21 in communication with the combustion chamber 10. A combustion element 12 is disposed in the combustion chamber 10. A barrel 84 is disposed in the main portion 82 of the shell 81. The barrel 84 is connected with the main body 85 so that heat can be transferred to the barrel 84 from the main body 85. Solid glue is fed into the barrel 84. The solid glue is heated and molten in the barrel 84. The molten glue is dispensed from the barrel 84. Problems have been encountered in the use of the glue gun 80. Firstly, it takes quite some time for heat to reach the barrel 84 from the main body 85. This entails a high operative cost. Secondly, it is difficult for hot exhaust to leave the combustion chamber 10 through the exhaust port 21 because the hot exhaust tends to rise while the exhaust port 21 extends downwards. An undesired amount of heat accumulates in the combustion chamber 10. The temperature of the main body 85 and the barrel 84 reaches an undesired value. This high temperature may damage the glue gun and hurt a user.

As disclosed in U.S. Pat. Nos. 5,901,881 and 5,960,996, a combustion chamber is located in a lower portion of a barrel. Therefore, it is hard to expel hot exhaust.

The present invention is therefore intended to obviate or at least alleviate the problems encountered in the prior art.

SUMMARY OF INVENTION

According to the present invention, a glue gun includes a shell, a burner, a mixture chamber, a barrel and a dispenser. The burner is disposed in the shell and formed with a combustion chamber and a thermal chamber. The mixture chamber is connected to the combustion chamber. The barrel is inserted through the thermal chamber. The dispenser is connected to the barrel. Gas is mixed with air in the mixture chamber. The mixture is sent into the combustion chamber from the mixture chamber. Heat is generated as the mixture is ignited and combusted in the combustion chamber. The thermal chamber transfers the heat to the barrel from the combustion chamber. The barrel heats and melts a glue stick inserted therein. The dispenser dispenses the molten glue from the barrel.

The primary advantage of the glue gun according to the present invention is a low cost in use since the heat is well reserved.

Other advantages and features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
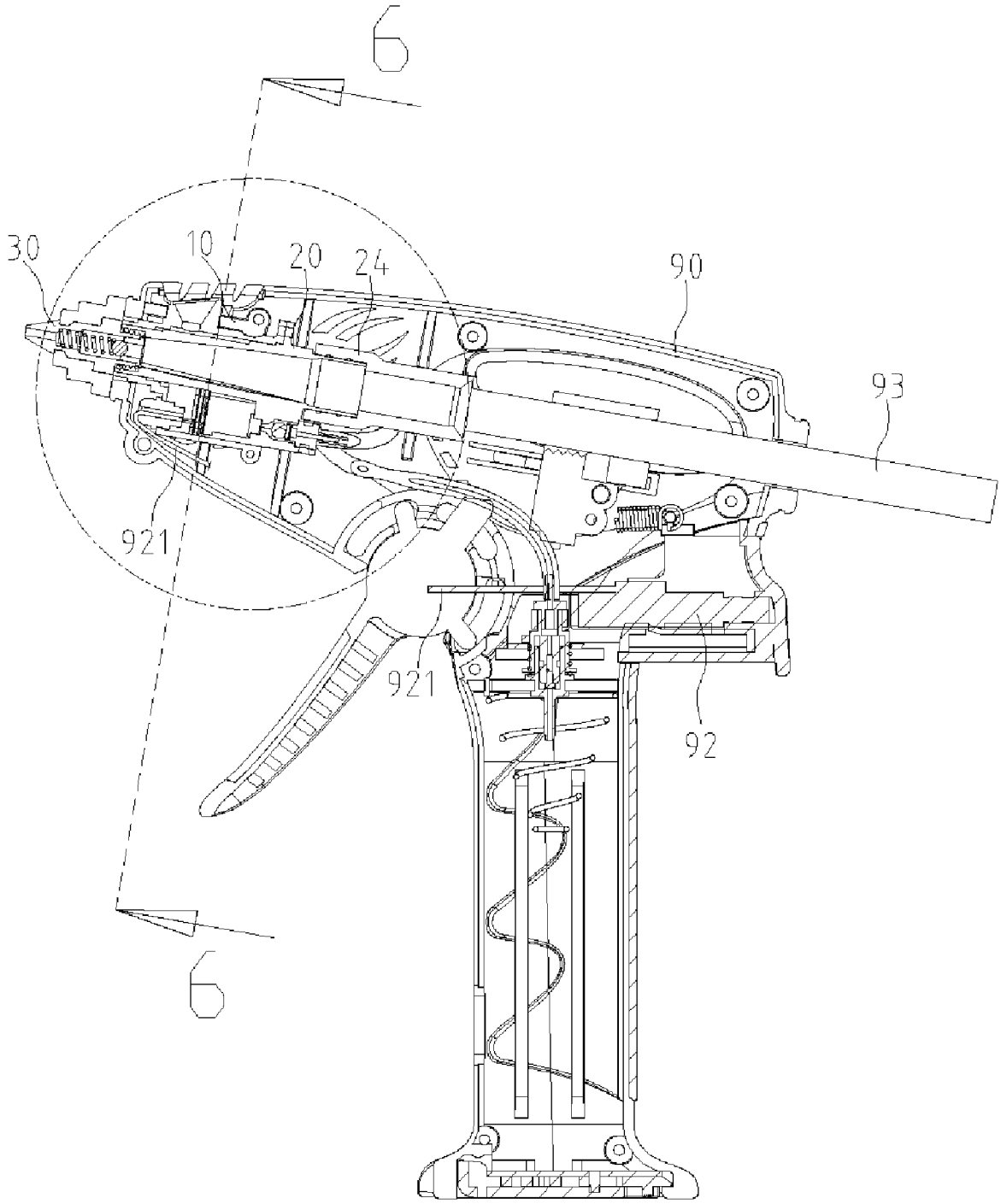
FIG. 1 is a cross-sectional view of a gas-powered glue gun according to the preferred embodiment of the present invention.
Figure 2:
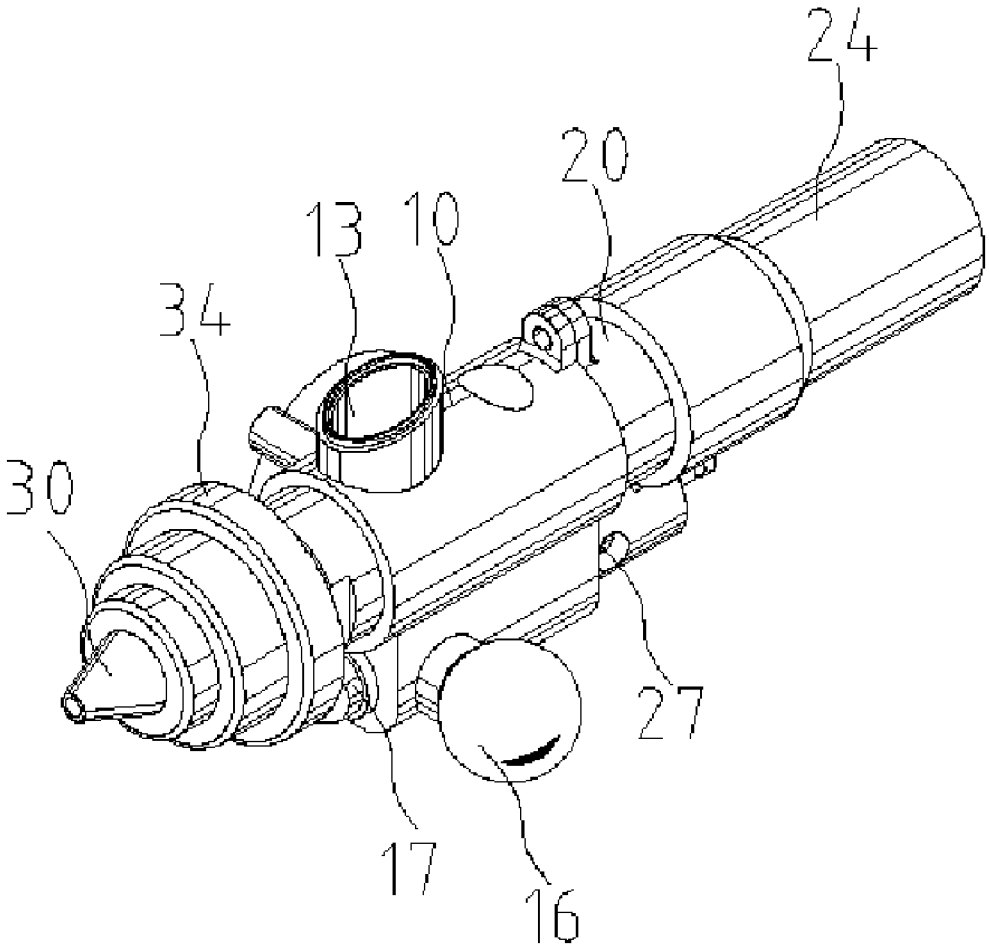
FIG. 2 is a perspective view of a heater used in the gas-powered glue gun shown in FIG. 1.
Figure 3:
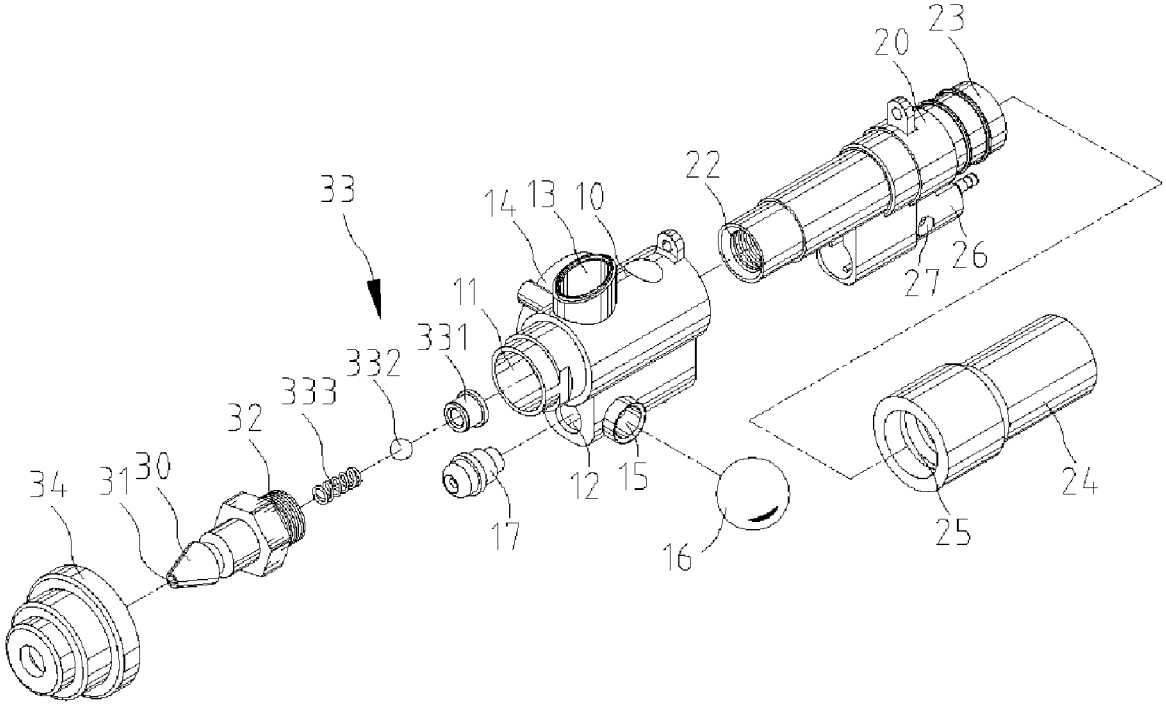
FIG. 3 is an exploded view of the heater shown in FIG. 2.
Figure 4:
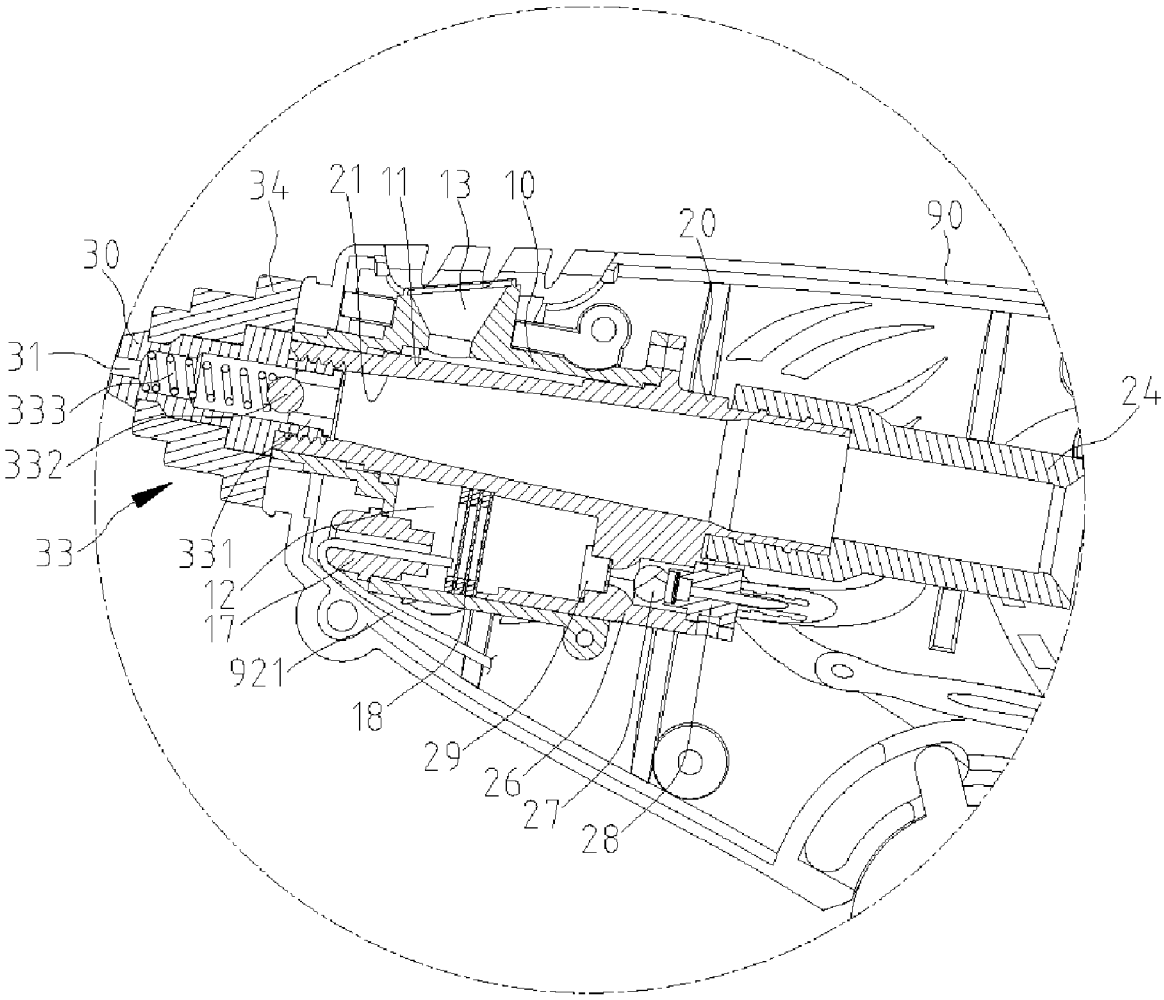
FIG. 4 is an enlarged partial view of the glue gun shown in FIG. 1.

Referring to FIGS. 1 through 6, a gas-powered glue gun includes a shell 90, a burner 10, a mixture chamber 26, a barrel 20 and a dispenser 30 according to the preferred embodiment of the present invention.

The burner 10 includes a combustion chamber 12, a thermal chamber 11 formed next to the combustion chamber 12, an exhaust port 13 formed on the thermal chamber 11, a seat 14 formed on a side of the combustion chamber 12 and the thermal chamber 11, a window 15 defined in the combustion chamber 12 and a magnifier 16 for covering the window 15. The magnifier 16 is preferably a glass ball. A piezoelectric ceramic ring 17 is fit in an aperture defined in a front portion of the combustion chamber 12. An ignition lead 921 of a piezoelectric switch 92 is inserted into the combustion chamber 12 through the piezoelectric ceramic ring 17. A catalytic net 18 is disposed in the combustion chamber 12 to prevent fierce flames. A security device 91 is disposed in the seat 14.

Inherently, the barrel 20 includes a tunnel 21 defined therein. A thread 22 is formed on a front portion of the tunnel 21. Annular ribs 23 are formed on a rear portion of an external side of the barrel 20.

A receptacle 24 is formed with annular grooves 25 on an internal side. The annular grooves 25 receive the annular ribs 23 to connect the receptacle 24 to the barrel 20.

A mixture chamber 26 is formed together with the barrel 20. A throttle 27 is arranged on the mixture chamber 26. Air is admitted into the mixture chamber 26 through the throttle 27. Gas is admitted into the mixture chamber 26 through a nozzle 28 connected to a gas pipe. The gas is transformed from liquid into a gaseous state by the nozzle 28. The gas is mixed with the air in the mixture chamber 26. A rectifier 29 is used to rectify the mixture in the mixture chamber 26.

The front portion of the barrel 20 is inserted through the thermal chamber 11 while the rear portion of the same is located outside the thermal chamber 11. The mixture chamber 26 is in communication with the combustion chamber 12. The mixture is transferred from the mixture chamber 26 into the combustion chamber 12. Then, the mixture is ignited by the ignition lead 921.

The dispenser 30 includes a mouth 31 at an end and a thread 32 at an opposite end. The thread 32 is engaged with the thread 22 for attaching the dispenser 30 to the barrel 20.

There may be a check valve 33 for preventing undesired leakage of the molten glue through the dispenser 30. The check valve 33 includes a ring 331 located in the dispenser 30, a ball 332 and an elastic element 333 for pushing the ball 332 to the ring 331.

There may be a protective ring 34 around the dispenser 30 so that a user will not get burned by the dispenser 30.

Figure 5:
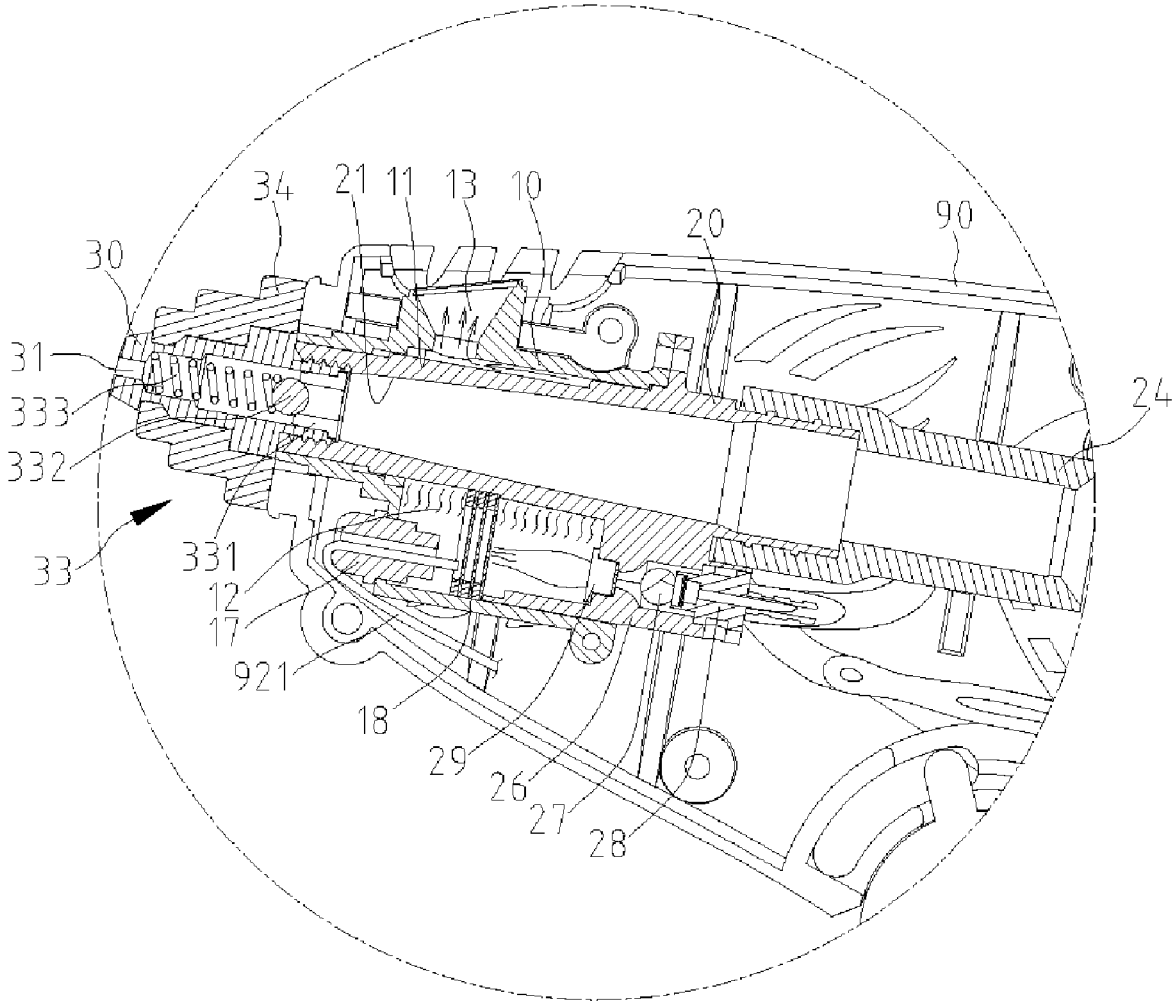
FIG. 5 shows how hot exhaust flows in the glue gun shown in FIG. 4.
Figure 6:
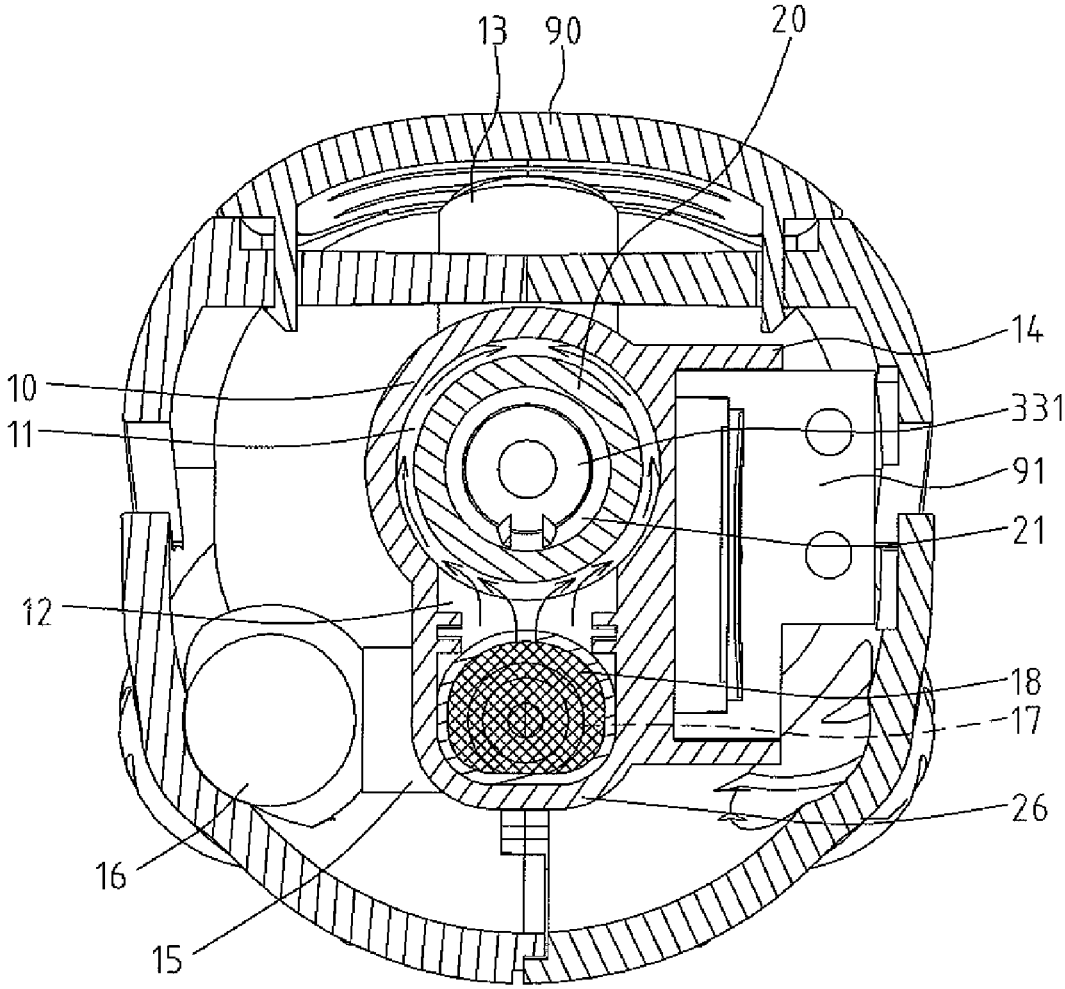
FIG. 6 is an enlarged cross-sectional view of the glue gun taken along a line 6-6 shown in FIG. 1.

Referring to FIGS. 5 and 6, when the mixture is ignited by the ignition lead 921 and burnt in the combustion chamber 12, flames and heat occur. The heat rises into the thermal chamber 11 and heats the barrel 20. The barrel 20 transfers the heat to the glue stick 93. The glue stick 93 gets molten so that it can easily be dispensed through the dispenser 30. Hot exhaust is expelled through the exhaust port 13.

The burner 10 absorbs a portion of the heat and gets hot as the burning continues. On detecting that the temperature of the burner 10 reaches an upper limit, the security device 91 closes the nozzle 28 to stop the gas and eventually put out the flames. No more heat is generated. The barrel 20 however continues to be operatively hot for some time as it is separated from cold air by the thermal chamber 11.

The glue gun according to the present invention exhibits at least two advantages. Firstly, it is secured for using the security device 91 to prevent overheating. Secondly, it is thermally efficient and economic since the heat is well reserved and the combustion does not continue throughout the entire operation.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A glue gun comprising:

a barrel receiving, heating and melting a glue stick producing molten glue;

a mixture chamber producing a mixture of gas with air;

a burner comprising an upper portion and a lower portion, with the lower portion exposed to and in communication with the upper portion, with the upper portion having a wall, with the lower portion having a sidewall, with the sidewall of the lower portion distinct and spaced from the barrel and defining a combustion chamber in the lower portion, with the combustion chamber exposed to and in communication with the barrel, with the mixture of gas with air receivable in the combustion chamber, with the combustion chamber burning the mixture of gas with air to generate heat, with the wall of the upper portion distinct and spaced from the barrel and defining a thermal chamber in the upper portion, with the thermal chamber intermediate the barrel and the upper portion, with the thermal chamber in thermal communication with the barrel and the combustion chamber, with the combustion chamber and the thermal chamber extending 360 degrees circumferentially around the barrel wall, with the heat flowing to the thermal chamber from the combustion chamber surrounding and transferring to the barrel, with the burner further comprising an exhaust port extending from the thermal chamber; and a dispenser dispensing the molten glue from the barrel, with the dispenser secured to the barrel.

2. The glue gun according to claim 1 wherein the thermal chamber is located above the combustion chamber, with the heat transferred efficiently from the combustion chamber to the thermal chamber.

3. The glue gun according to claim 1 wherein the barrel is formed together with the mixture chamber.

4. The glue gun according to claim 1 wherein the barrel is formed with a tunnel therethrough, with the tunnel having a front portion contacting the dispenser, with a barrel thread formed in the front portion of the tunnel of the barrel, and the dispenser is formed with a hole receiving the molten glue from the tunnel of the barrel and an outside spaced from and opposite the hole, with the dispenser having an opposite end contacting the barrel, with a dispenser thread formed on the outside of the dispenser at the opposite end of the dispenser, and with the dispenser thread engaged with the barrel thread.

5. The glue gun according to claim 1 wherein the burner comprises a catalytic net disposed in the combustion chamber to prevent fierce flames.

6. The glue gun according to claim 1 further comprising a nozzle to control travel of the gas into the mixture chamber.

7. The glue gun according to claim 1 further comprising a throttle to control travel of the air into the mixture chamber.

8. The glue gun according to claim 1 further comprising a rectifier to rectify spray of the mixture of gas with air in the mixture chamber.

9. The glue gun according to claim 1 comprising an ignition lead disposed in the combustion chamber.

10. The glue gun according to claim 9 comprising a piezoelectric ceramic ring attached to the combustion chamber, wherein the ignition lead is inserted through the piezoelectric ceramic ring.

11. The glue gun according to claim 1 further comprising a check valve disposed in the dispenser preventing leakage of the molten glue through the dispenser.

12. The glue gun according to claim 11 wherein the check valve comprises a ring disposed in the dispenser, with the dispenser contacting the barrel, a ball positioned completely within the dispenser, and an elastic element disposed in the dispenser and pushing the ball to the ring, with the barrel formed with a tunnel therethrough, with the ball partially inside the ring and partially in the tunnel of the barrel, with the tunnel of the barrel in communication with the ring, with the ring in communication with the dispenser, and with the ring partially abutting the tunnel of the barrel and partially inside and abutting the dispenser.

13. The glue gun according to claim 1 further comprising a receptacle guiding the glue stick into the barrel.

14. The glue gun according to claim 13 wherein one of the barrel and the receptacle is formed with at least one annular rib, with the barrel extending toward the dispenser and defining a gluestick guiding direction, with the at least one annular rib extending circumferentially outward transverse to the gluestick guiding direction while the other of the barrel and the receptacle is formed with at least one annular groove extending circumferentially inward transverse to the gluestick guiding direction and receiving the at least one annular rib in abutting engagement.

15. The glue gun according to claim 1 comprising a security device stopping the gas on detecting that a temperature of the burner reaches an upper limit.

16. The glue gun according to claim 1 comprising a protective ring around the dispenser, with the dispenser having a hole receiving the molten glue from the tunnel of the barrel and an outside spaced from and opposite the hole, with the protective ring forming a cavity, with the cavity in direct contact with the outside of the dispenser, and with the protective ring separately formed from the dispenser.

17. The glue gun according to claim 1 wherein the exhaust port is opposite and spaced from the combustion chamber, with the barrel intermediate the exhaust port and the combustion chamber, with the exhaust port in communication with the thermal chamber, and with the heat flowing from the thermal chamber to the exhaust port.

* * * * *